United States Patent [19]

Blottiere et al.

[11] Patent Number: 4,722,770

[45] Date of Patent: Feb. 2, 1988

[54] METHOD FOR MAKING CONTINUOUS AND CLOSED HOLLOW BODIES, HOLLOW BODIES SO OBTAINED AND APPARATUS FOR MAKING THE HOLLOW SPHERES

[75] Inventors: Yves Blottiere, Montauban; Jean-Pierre Bonino, Toulouse; Abel Rousset, Ramonville; Claude Rossignol, Montauban; Isabelle Gossart, Chatenay Malabry, all of France

[73] Assignees: Universite Paul Sabatier, Toulouse; S.A. Ateca, Montauban, both of France

[21] Appl. No.: 888,855

[22] Filed: Jul. 24, 1986

[30] Foreign Application Priority Data

Jul. 25, 1985 [FR] France ..... 85 11747

[51] Int. Cl.[4] ..... C25D 1/02

[52] U.S. Cl. ..... 204/9

[58] Field of Search ..... 204/9, 25, 38.4, 38.5

[56] References Cited

U.S. PATENT DOCUMENTS 4,464,231 8/1984 Little ..... 204/9

FOREIGN PATENT DOCUMENTS 351060 1/1905 France ..... 204/9

1311777 4/1961 France ..... 204/9

OTHER PUBLICATIONS

Chemical Abstracts, vol. 101, 1984, p. 470, Nos. 62625v, 62626w, Columbus, Ohio, U.S.; & JP-A-59 35 695 (Sanyo Electric Co., Ltd.) 27-02-1984-JPA 59-35 696 (Sanyo Electric Co., Ltd.) 27-02-1984.

*Primary Examiner*—T. M. Tufariello

*Attorney, Agent, or Firm*—Harold H. Dutton, Jr.

[57] ABSTRACT

A method for manufacturing continuous, closed and hollow bodies which comprises (a) using cores (25) which are soluble in a solvent, (b) depositing on each core a coating (3) with a suitable mechanical strength to be self-supporting and having open pores to pass a solvent, and (c) placing the cores so coated into a solvent for dissolving the cores; the method of the invention may be implemented in bulk parts, in an economical manner, and allows making hollow bodies, in particular hollow balls, each comprising a continuous skin devoid of any macroscopic perforation and of a kind and with a thickness which are easily adjusted in relation to the desired properties.

18 Claims, 14 Drawing Figures

FIG. 7

| Materials / Techniques | Pure Metals | Alloys | Amorphous Materials | Ceramics | Magnetic Materials | Fiber Composites | Plastics |
|---|---|---|---|---|---|---|---|
| Electroplating ($b_3$) | Cr, Ni, Cu,... | Ni - Co<br>Ni - Fe<br>Ni - Mo | Ni - P<br>Ni - B<br>Ni - Fe - P | | Ni - X<br>Fe - X<br>Co - X | | |
| Chemical deposition before dissolution ($b_4$) | Cu, Ni, Ni/P,... | | | | | | |
| Chemical deposition in the vapor phase after dissolution (d) | | | Si $O_2$ | $Al_2O_3$<br>Ti $O_2$ | | | |
| Dipping deposition after dissolution (d) | All metals | Steels brasses light alloys | | | | | Rubber plastics |
| Cathode Sputtering | Al; Ti, Fe, Cu, Ni,... | Rare-earth/ metal | | | | | |
| Vacuum evaporation (d) | Al, Cu, Ag, Fe, Ni,... | Ni - Cr<br>Ni - Cu<br>Ti - Al | | $Al_2O_3$ | | | |
| Duplicate moulding (d) | All metals | Light alloys and others | | | | Carbon | Rubber plastics: silicon |

METHOD FOR MAKING CONTINUOUS AND CLOSED HOLLOW BODIES, HOLLOW BODIES SO OBTAINED AND APPARATUS FOR MAKING THE HOLLOW SPHERES

This invention relates to a method for manufacturing continuous and closed hollow bodies. More particularly, it relates to making hollow spheres comprising a continuous spheriod skin enclosing an empty internal volume. The invention further applies to hollow bodies, in particular hollow spheres made by carrying out the method, and further relates to equipment for implementing a preferred stage of the method.

BACKGROUND AND OBJECTS OF THE INVENTION

There is a need in many industrial fields for hollow bodies without any macroscopic surface discontinuity. As a rule, the function of such bodies is to lessen the weight of a part while enabling it to meet the requirements of the particular application. These hollow spheres in particular may be used to make a modular composite material characterized essentially by its low weight and its isotropic properties easily fitting the particular needs. Hollow spheres also find significant applications in catalytic materials because they provide very large specific surfaces per unit weight. Furthermore there are more conventional applications for hollow bodies, in particular in mechanical engineering: balls of ball-bearings, hollow mechanical parts offering very low weight and suitable mechanical strength, and the like.

Presently several kinds of processes are known for making hollow bodies, in particular hollow balls or spheres. In all these processes, the hollow bodies are manufactured sequentially and undergo individual fabrication stages requiring accurate positioning of each piece. Consequently these procedures are costly as a rule while automating them demands complex and costly equipment.

A first type of procedure comprises making two shells by molding or stamping and in assembling them by any known means. This procedure comprises several sequential stages each requiring accurate positioning on work sites and its use is suited only for high-value units.

Another type of procedure employed in particular in the manufacture of small balls for small chains comprises stamping them from a tube. While much more economical, this procedure however does incur several drawbacks: in the first place, it does not provide a continuous ball surface because each ball will comprise two holes; further, the stamping technique used only allows making balls over a narrow range of thickness and only with a very restricted selection of materials, namely materials capable of flow without cracking.

Another procedure offers the advantage of accurately reproducing a given shape and comprises making each hollow body individually by electroforming at the end of a soluble electrode around an expendable mandril. However by its very nature this is a very costly procedure which furthermore results in hollow bodies including a removal orifice.

Another type of procedure comprises coating a core with a solid and then fashioning a hole in this coating to let through a solvent for dissolving the core (French patent No. 1,311,777; U.S. Pat. No. 4,464,231). However this procedure requiring individual mechanical drilling of each ball is incompatible with mass production and therefore incurs the same disadvantages as above. Moreover, the hole in the ball degrades its homogeneity and its overall strength and resistance.

For completeness, mention also must be the very ancient procedure of glass blowing which however is restricted to this material and causes difficulties in controlling the shape of the hollow body.

The primary object, then, of this invention is to provide a novel manufacturing method for continuous, closed and hollow bodies.

Another object of the invention is to provide a method which can be implemented on pieces in bulk which therefore need not be positioned during the processing stages.

Still another object is to enable the manufacture of hollow bodies, in particular hollow spheres each comprising a continuous skin free from any macroscopic perforation.

Yet another object is to enable the manufacture of hollow bodies of diverse materials and with thickness which can be easily adjusted in relation to the properties sought.

A further object is to create composite hollow bodies, that is bodies of which the skin comprises several layers which may have different properties and which may be combined in order to meet the requirements of the particular application.

Yet a further object is to provide a method allowing the economical manufacture and in very large quantities of small hollow balls with an outer diameter larger than 0.6 mm and a skin thickness at least 50 microns.

Still another object is allow matching the surface condition of the hollow bodies or balls to the applications under consideration.

DESCRIPTION OF THE INVENTION

The method of the invention for making continuous, closed and hollow bodies comprises:

(a) using cores of a material soluble in a solvent and having a shape corresponding to the inner cavity of the hollow bodies to be manufactured, (b) depositing on each soluble core a porous coat with a suitable mechanical strength to be self-supporting and having open pores to let the solvent to pass through, (c) placing the cores so coated into the solvent until these cores have dissolved.

Accordingly the method of the invention comprises manufacturing each body by depositing a continuous but porous coating in order to thereafter eliminate these inner cores by dissolution through the pores. In the case of hollow balls, spherical cores are used with a diameter matched to that of the balls to be made and generally in excess of 0.5 mm. The method of the invention includes only operations which can be carried out on in-bulk goods and therefore eliminates any accessory positioning which would be a substantial cost increase in the implementation. Furthermore the method of the invention provides hollow bodies with a totally continuous surface lacking any perforation or macroscopic discontinuity.

According to a preferred characteristic of the invention, (a) cores are used which have a plurality of small cavities open on the outer surface of said cores, and (b) the coating is carried out essentially on the surface beside the cavities so as to achieve a coating with pores at the cavities. Illustratively, expanded plastic foam cores may be used, of which the cells are open on the outer surface.

Accordingly, after deposition, a porous coating is obtained, of which the pores are determined by the expansion rate of the selected plastic. The expansion rate is selected so that the coating will have a porosity which thereafter allows proper solvent penetration for dissolving the cores.

In particular, expanded polystyrene cores may be used, which may then be dissolved for instance by immersion in a solvent such as acetone, benzene, perchloroethylene, trichloroethylene or ether.

The cores used in the method of the invention may be made in their matching shape by any known procedure, and in particular in the case of expanded plastic balls, by atomizing drops of expanding material in a liquid. This kind of procedure presently is well known and allows making sperical cores of which the diameters can be adjusted in relation to the conditions of application.

Also, in an advantageous embodiment of the invention, the deposition of the porous coating on each of the cores comprises:

($b_1$) roughing the cores so as to create the proper roughness on their surface beyond the cavities to allow mechanically bonding the surface to metals, ($b_2$) immersing the cores into at least one chemical metallizing bath in order to deposit at least one thin, conducting film on said cores, ($b_3$) immersing the cores thus processed into at least one electrolytic bath in order to electroplate at least one metal on the thin, conducting films.

Such a metallization procedure is known per se and is in use already to make metallized plastic objects (however the metallization in this case takes place on a continuous, impermeable surface and provides a dense metal surface). In the case of the present invention, on the other hand, the small cavities of the cores result in a porous coating allowing the subsequent dissolving stage.

The chemical roughing operation ($b_1$) comprises in particular immersing the cores in bulk in a dilute solvent or dilute acid, agitating the cores in the bath and then in rinsing them after an immersion time corresponding to the desired surface action on the cores. This roughing changes the surface condition of the core between the cavities and creates roughnesses assuring the subsequent good adhesion of the thin conducting film deposited in the next stop ($b_2$).

Illustratively in the case of expanded polystyrene cores, the chemical roughing ($b_1$) is carried out by immersion in acetone diluted in water at a concentration by volume of between 50 and 90% for a time lasting between 600 and 5 seconds. The time of immersion is controlled within this range as an inverse function of concentration in order to adequately act locally on the core surfaces while avoiding their destruction or too great a change in their shape.

The metal coating(s) deposited in the step ($b_2$) are very thin because the single immersion technique does not allow achieving coat thickness exceeding about 5 microns. The metallization coating(s) merely are intended to make the core surface conducting in order to subsequently undertake electroplating ($b_3$) whereby coatings of arbitrary thickness can be deposited.

In a known manner, this metallization step ($b_2$) can be carried out by immersing the cores in bulk and consecutively in three chemical metallization baths, the first one being based on a copper or nickel salt in order to deposit a thin sensitizing zinc layer, the second being based on a silver or palladium salt in order to deposit a catalytic silver or palladium film, the third being based on a copper or nickel salt in order to deposit a thin copper or nickel conducting film. The tin film favors an oxidation-reduction reaction during the immersion in the second bath but is insufficient to provide a suitably conducting surface. The tin bath preferably includes surfactants favoring the wetting of the core surfaces. The silver or palladium film acts as a catalyst during the immersion in the third bath but would also be inadequate to impart to the surface adequate conductivity during electroplating.

The conducting film obtained during the immersion in the third bath may be about 10 microns thick and offers an electrical conductivity well suited for electroplating.

This electroplating ($b_3$) preferably comprises:

placing the bulk cores in an open rotating barrel equipped at it top with cathodes, immersing the barrel in a metal salt-based electrolytic bath containing anodes immersed into the bath opposite the barrel, and applying a voltage difference across the anodes and cathodes for a time depending on the thickness of the desired metal coating.

In particular the electrolytic bath may be based on a nickel salt in order to obtain a crystalline nickel alloy coat. It may also be based on a nickel salt with addition of metalloid complexes (known per se) in order to obtain an amorphous nickel alloy coat.

In this manner a self-supporting coating is obtained which preferable is thicker than 50 microns and of which the thickness can be controlled by merely varying the duration of electroplating. It should be noted that the conducting film ($b_2$) essentially affects the outer surface beyond the core cavities. Therefore the electrolytic deposition takes place solely on that surface and the porous nature of the coating in ensured thereby regardless of its thickness.

Several electroplatings may be carried out serially in order to achieve a multi-layer coating of which the layers may be different in nature in order to evince different properties. Electroplating makes it easy to deposit such metals as nickel, iron, chromium, molybdenum, tungsten, cobalt and also alloys of these metals, either in crystalline or amorphous form.

These electroplating operations where called for may be followed by the chemical deposition of a metal layer ($b_4$) by immersion in a chemical metallization bath in order to form a thin surface layer. This new deposit takes place on already eletroplated metal which acts as a catalyst with respect to the deposit, whereby the porous nature of the coating may be retained. The new layer so formed may be significant in some applications to endow the hollow body or sphere with an anti-corrosive surface (illustratively, coatings of nickel-boron, nickel-phosphorus alloy etc.), or also to increase the electrical conductivity of the hollow body body (new copper layer).

The core-dissolving operation (c) is carried out in the cold or at low temperature by immersing in bulk into the solvent. This operation allows totally eliminating each core without affecting the previously formed skin and without generating a pollution of this skin or stressing it mechanically In particular, such a dissolution makes it possible to avoid grain growth in crystalline alloys and consequently to retain the coating's hardness.

Such dissolution holds no risk at all of recrystallization in the material that would change its properties.

Where called for, the inner films or layers used in electroplating (sensitizing film, catalytic and thin conducting layer) themselves may be dissolved in a selective solvent preserving the upper electroplated layer(s).

After the cores have been dissolved (and possibly too the inner films or layers), it is possible (d) to deposit on the porous coating an impermeable layer to eliminate the porosity of the the object or to clad it with a different material suitable for the application. This layer may be achieved by a great many known procedures (immersion, cathode sputtering, vacuum evaporation, chemical deposition in the vapor phase, duplicate molding etc.) and accordingly may be carried out on a great many materials (amorphous or cyrystalline alloys, refractory steels, ceramics, plastics, metal oxides and their alloys, elastomers etc.)

In the form of a novel product, the invention covers the hollow bodies, in particular of spheroidal shape, which are manufactured by the above described method, each hollow body being characterized by continuous and closed skin around an empty inner volume.

The invention also relates to dipping equipment whereby the immersion operation (d) of the hollow balls is carried out under optimum conditions in order to achieve a dense coat around the porous coatings following the core dissolution. The equipment of the present invention comprises a crucible containing a bath of a hardening liquid, a rotating wheel located above the crucible so that its rim moves closed to the bath, means for rotationally driving the wheel, a guide spout for the balls with a segment located in the crucible so as to pass through the bath near the wheel rim, means for supplying said spout with balls and means for receiving the balls ejected from the spout end.

DESCRIPTION OF THE DRAWINGS

Other features, objects and advantages of the invention will become clear in relation to the description below and in reference to the attached drawings showing on one hand schematics of the equipment used and on the other hand illustrative implementing steps for Examples 1 and 2 as regards the manufacture of balls and lastly a table of the nature of the deposition which can be obtained by the corresponding techniques.

FIGS. *5a, 5b, 5c, 5d, 5e, 5f,* and *5g* are schematic views illustrating the method of the invention (Example 1) and FIGS. *6a* and *6b* are schematic views relating to Example 2; and FIG. 7 is a table listing the various kinds of hollow bodies made possible by the invention.

DESCRIPTION OF PREFERRED EMBODIMENTS

Figure 1:
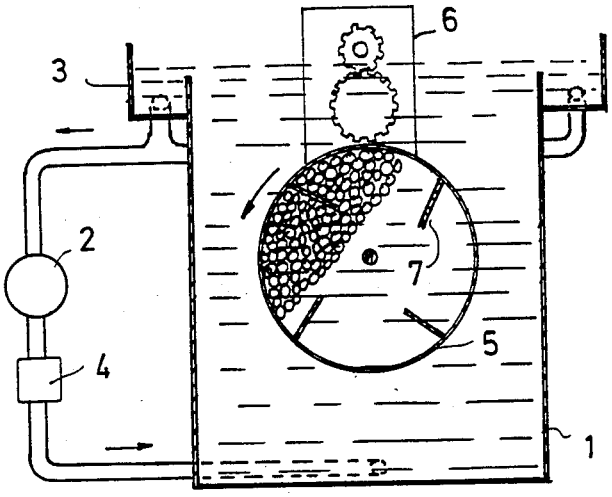
FIGS. 1 and 2 are cross-sections of conventional equipment for the implementation of the method steps.

The apparatus shown in FIG. 1 permits carrying out the following operations on the bulk balls:

($b_1$) roughing the surfaces of the spheroidal cores;

($b_2$) depositing a sensitizing film of tin, depositing a thin silver or palladium catalytic film, and depositing a copper or nickel conducting layer; and (c) dissolving the cores.

This equipment includes a tub 1 filled with a bath suited to the processing to be carried out. This bath is made to circulate by pump 2 which takes in liquid at the upper part from an overflow basin 3 and forces it at the lower part into the tub. Filtering means 4 is associated with the pump 2.

The tub 1 includes an open barrel 5 rotationally mounted on two pivots supported by columns 6. This barrel as a rule is made of open-mesh polypropylene and is equipped on its periphery with a toothed crown engaging gears in turn driven by an electric motor. The rotational speed of the barrel of the Examples is 50 rpm.

The barrel is equipped on its inside with baffles 7 assuring that the balls shall be agitated within the bath. Where called for, a system of heat pipes with thermostats permits raising the bath temperature to about 100° C.

Figure 2:
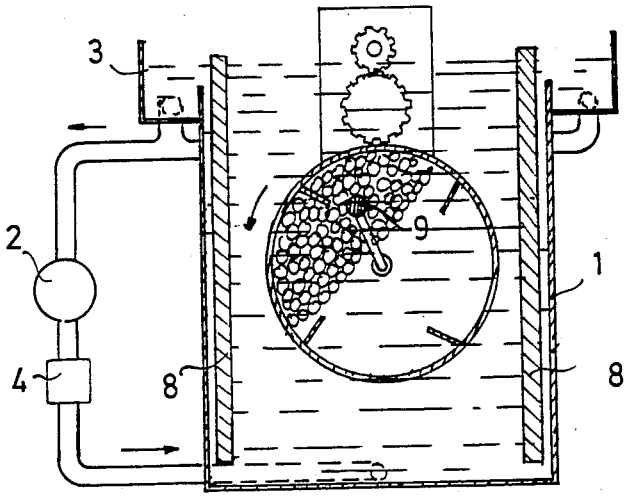

The equipment shown in diagrammatic form in FIG. 2 allows electroplating the balls in bulk in one or more steps ($b_3$).

This equipment is similar to the preceding but additionally includes:

a set of anodes such as 8 comprising plates of the metal to be deposited and located opposite and on each side of the barrel, a set of cathodes such as 9 comprising solid stainless steel balls located along the barrel at its upper part and being offset from it in the direction of rotation.

The anodes 8 are in parallel with each other and connected to the positive terminal of a stabilized DC power supply while the cathodes also connected parallel to each other are connected to the negative terminal terminal of this power supply.

The rotational speed of the barrel of the Examples is 0.6 rpm.

Figure 3:
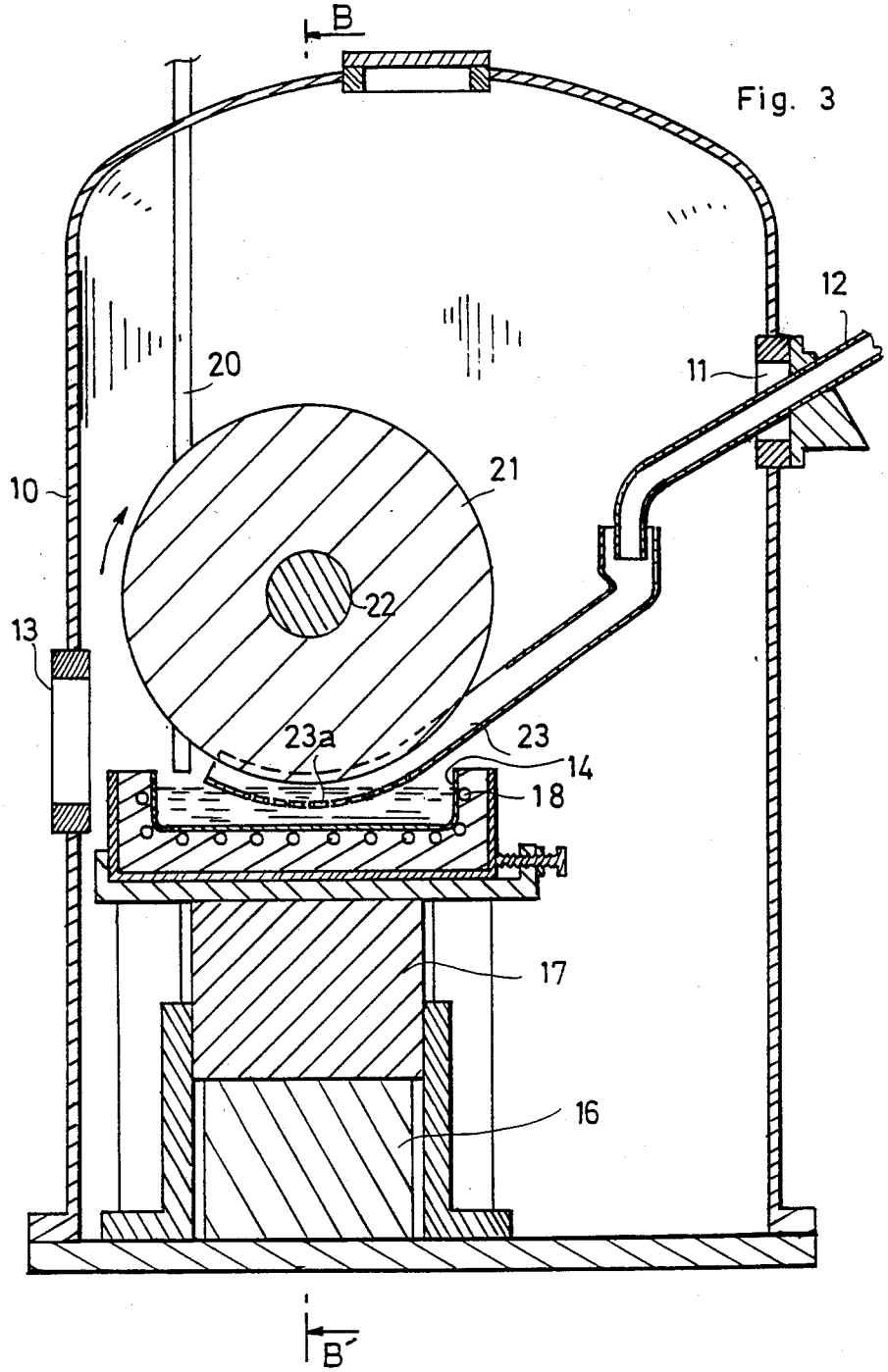
FIGS. 3 and 4 are cross-sections respectively of a 15 vertical plane A—A' and a vertical plane B—B' perpendicular thereto of apparatus for a preferred method step.
Figure 4:
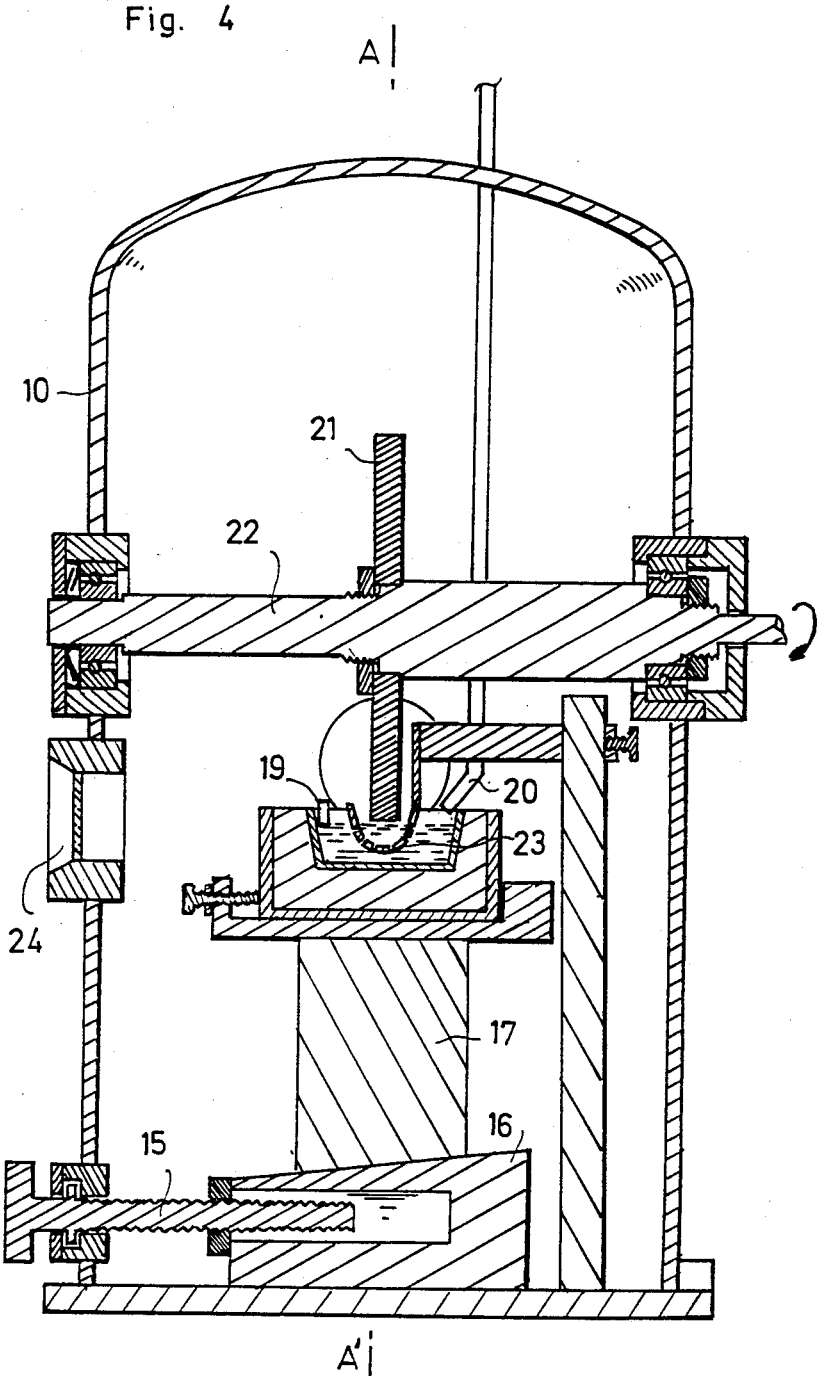

The equipment shown in FIGS. 3 and 4 allows carrying out on the balls in bulk a complementary deposition (d) of one or more impermeable layers following the dissolution of the cores.

This equipment comprises an enclosure 10 with an intake 11 through which pass ball feeding means 12 and a discharge 13 through which the balls are ejected. Receiving means (not shown) for the balls are associated with this discharge 13 outside the enclosure. This receiver may comprise a cooled enclosure.

The enclosure 10 comprises a crucible 14 holding a liquid bath of the hardening material to be deposited. This crucible 14 is supported by height-adjustable means, namely a micrometer screw 15 which moves a trapezoidal skid 16 supporting the crucible rest 17.

The crucible 14 is equipped with such heating means as the electric resistance 18 (or an induction heater). A thermostat (not shown) allows regulating the bath temperature precisely at the desired value.

Furthermore, the crucible 14 is provided with means for regulating the level of the liquid bath. In the example, the regulating means comprises a microswitch schematically shown at 19 which controls the material input (as a rule in the form of powder, but where called for as a liquid) in a feed conduit 20. This level regulating means also may comprise any other known system and in particular an optical system.

The enclosure contains a rotating wheel 21 supported on a shaft 22 driven by an electric motor (not shown) at a rotational speed of 300 rpm in these Examples. This wheel 21 is located in a vertical plane above the crucible 14 so that its rim passes near the bath surface without touching it.

A ball guiding spout 23 is located between the feed means (conduit 12) and the basin 14. This spout comprises to open segment 23*a* located in the basin and passes through the bath near the rim of the wheel 21.

This segment 23*a* is in the form of an arc of circle concentric with the wheel so as to cap the wheel at its lower part, where this wheel enters the spout as far as the vicinity of the bath surface. A window 24 permits observing the inside of the enclosure.

The balls to be coated are introduced through the conduit 12 into the spout 23. This introduction can be implemented piecewise by a vibrating bowl feeder. The balls move by gravity to the bath surface where they are carried away by the wheel 21. This wheel then forces them to rotate about themselves and it immerses them in the bath all while driving them toward the discharge.

Experiment has shown that such equipment allows homogeneous coatings on each ball because of:

a remarkably constant dwell time for all balls in the bath, uniform contact of the entire surface with the bath (because of the motions undergone by the balls), elimination of any danger of the balls adhering to one another.

At the bath exit, the balls are ejected toward the discharge 13 and in the case of hot deposition are then cooled.

The two Examples below illustrate the sequential steps of the method of the invention and were carried out by means of the above-described equipment.

EXAMPLE 1

The hollow balls made in this example will be used in making a modular composite material described in the already cited patent application which was filed simultaneously with the present one.

Figure 5A:
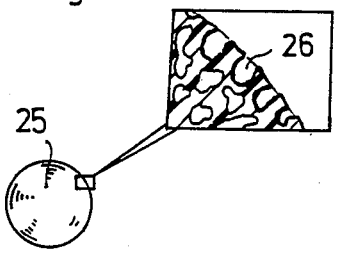

Step a:

The balls are made from spheroidal cores of expanded polystyrene schematically shown at 25 in FIG. 5*a*. The diameter of these cores is selected to be about 6 mm. The core density is 80 kg/m$^3$.

Each core has a multitude of small cavities such as 26 open at their outer surface.

The manufacture of these cores is well known and they are in this example a product of TOULPAC (Toulouse).

Step $b_1$:

The first processing stage comprises roughing the core surface by immersing them in a solvent of the following composition by volume:

acetone: 90% deionized water: 10%

This immersion took place in the equipment shown in FIG. 1 for 5 minutes at an ambient temperature of 20° C.

Then, two consecutive rinses were carried out in the same equipment using deonized water and each time for about 2 minutes.

Figure 5B:
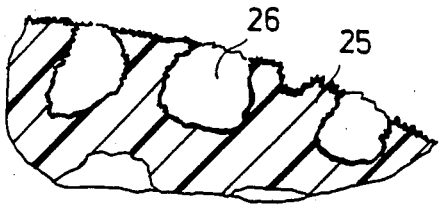

After this roughing operation, the outer surface of each core has a roughness such as is schematically shown in FIG. 5*b*, allowing the adhesion of the first film deposited in the next step.

Step $b_2$:

This step is carried out in three consecutive stages under the following conditions in the equipment of FIG. 1:

1st stage of step $b_2$: (sensitizing film)

The bath is aqueous and prepared with deionized water, having the following concentrations:

tin chloride: 40 g/liter hydrochlorid acid: 40 ml/liter wetting agent: 0.1 ml/liter The deposition is carried out at room temperature for 10 minutes. It is followed by two rinses with deionized water. A very thin tin layer is obtained which will enhance the reduction reaction taking place in the next stage.

2nd stage of step $b_2$ (catalytic film)

The aqueous bath is prepared with deionized water and has the following composition:

silver nitrate: 10 g/liter ammonium hydroxide: added until the solution turns cloudy.

The processing treatment is at a temperature of 20° C. and lasts 10 seconds.

Deposition is followed by two rinses with deionized water. A thin silver layer is obtained which is catalyzed by the deposition of the next stage.

3rd stage of step $b_2$ (thin conducting layer)

The aqueous bath is prepared from deionized water and has the following composition:

copper sulfate: 24 g/liter

37% formic acid: 60 ml/liter

Rochelle salt: 110 ml/liter soda: 25 g/liter

The process temperature is 20° C. and lasts 20 minutes.

The process is followed by two rinses with deionized water and results in a thin copper conducting layer.

Figure 5C:
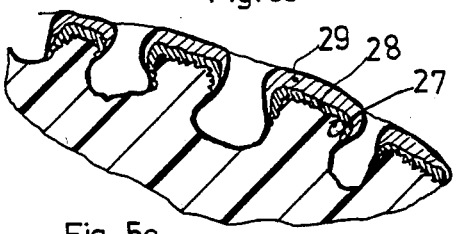

At the end of this step ($b_2$), the surface of each core looks as shown by FIG. 5*c*: the surface beyond the core cavities is covered with a first and very thin tin layer 27, with a second layer 28 which is thicker (about 10 microns).

Step $b_3$

This electroplating step is carried out in the equipment shown in FIG. 2 by means of an aqueous bath prepared form deionized water with the following composition:

nickel sulfamate: 350 g/liter boric acid: 40 g/liter nickel chloride: 5 g/liter antipitting (surfactant) agent: 0.1 ml/liter The processing conditions are as follows:

bath temperature: 55° C.

pH: 3.5 to 4.5 cathode current: 10 A/dm$^2$ time: 120 minutes

This processing is followed by two rinses similar to the preceding ones.

Figure 5D:
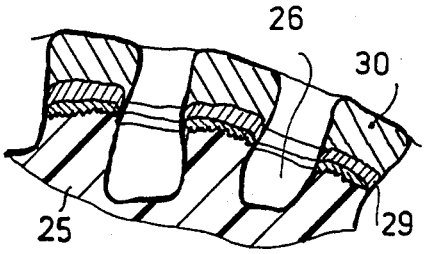
Figure 5E:
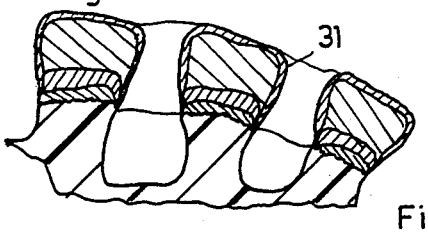
Figure 5G:
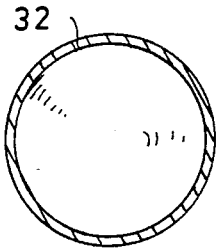

The balls so made have the appearance schematically shown in FIG. 5*d*. The conducting layer 29 is covered by a layer of crystalline nickel 30 about 120 microns thick.

The set of these layers forms a coating with open pores at the cavities 26 of the polystyrene core.

Step $b_4$

In this example, an additional layer is chemically deposited on the nickel layer 30 in order to improve the balls' corrosion resistance. This additional layer is schematically shown as 31 in FIG. 5*f* and retains the porous nature of the coating and accordingly may be deposited before the cores are dissolved.

The balls are immersed by the equipment of FIG. 1 into an aqueous bath prepared form deionized water containing products which are commercially available (made by Frappaz Imaza):

"Enplate 418 A": 60 ml/liter

"Enplate 419 B": 90 ml/liter

The bath temperature was raised to 98° C. and the processing was followed by two deionized water rinses and by oven drying.

In this manner an anti-corrosive chemical deposit of a micro-crystalline nickel/phosphorous alloy is obtained on the porous coating. The thickness of this deposit is about 5 microns.

Step c

Figure 5F:
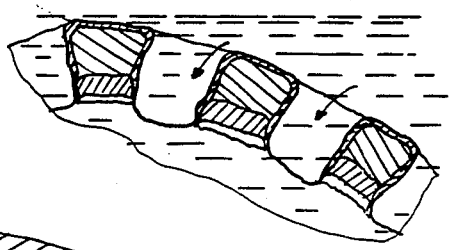

This step comprises immersing the balls in the equipment of FIG. 1 into a pure perchloroethylene solvent for 30 minutes (FIG. 5*f*).

At the end of processing, the cores are wholly dissolved and the balls then are oven-dried.

At the overall end of processing, balls such as schematically indicated at 32 are obtained with a diameter of about 6 mm and each having a continuous skin without any macroscopic discontinuity.

Compression tests were carried out on these balls and showed they have high compressive strength and wide range of plasticity as no rupture at all was noted under the maximum load of 12 bars, the balls being gradually crushed from 3 bars approximately on.

This excellent plasticity imparts good energy absorption to the balls when subjected to shock. Also their upper layer provides them with excellent corrosion resistance.

It should also be noted that the balls exhibit very homogeneous physical-chemical properties, the test having very narrow dispersion.

EXAMPLE 2

In this Example, the steps (a), ($b_1$), ($b_2$), ($b_3$) are identical with those of Example 1. The dissolution step (c) of the cores next is implemented again as in Example 1.

Step $d_1$

Figure 6A:
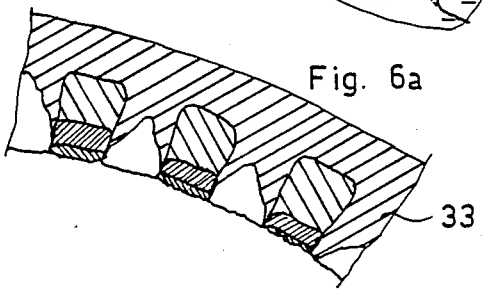

Next an impermeable metallic coat (such as is symbolically denoted by 33 in FIG. 6*a*) is made in the equipment of FIGS. 3 and 4.

This deposition by dipping is achieved by placing a melt of iron and chromium in respective composition of 75/25 and at a temperature of 1,520° C. in the crucible 14.

The enclosure 10 is filled with a reducing atmosphere, which is nitrogen. The dwell time of the balls in the bath is computed to be 0.2 to 0.3 seconds.

A deposit of crystalline alloy of iron and chromium is obtained with a thickness of about 100 microns, whereby the porosity of the balls is eliminated and their mechanical properties at high temperatures are achieved.

Step $d_2$

Figure 6B:
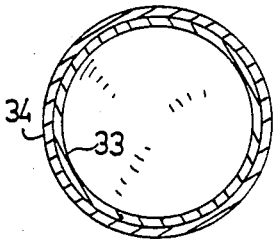

The balls so made next are subjected to a vapor-phase, chemical deposition of conventional type in order to coat them with a deposit of silicon oxide (represented at 34 of FIG. 6*b*). Such a surface deposit is about 10 microns thick and provides the ball with electrical insulation and good corrosion resistance.

Accordingly the method of the invention makes it possible to make balls (and more generally, hollow bodies) capable of meeting the requirements of the applications considered: mechanical, electrical, thermal, magnetic, elastic properties etc.

The table of FIG. 7 illustrates the wide-ranging choices made possible by the method.

While this invention has been described as having certain preferred features and embodiments, it will be understood that it is capable of still further variation, modification and elaboration without departing from the spirit of the invention, and this application is intended to cover any and all variations, modifications and adaptations of the invention as fall within the spirit of the invention and the scope of the appended claims.

We claim:

1. A method for manufacturing continuous, closed and hollow bodies, comprising providing cores (25) made of a soluble material having a shape corresponding to the inner empty volume of the hollow bodies to be manufactured, depositing on said cores a porous coating (30) having mechanical strength adequate to be self-supporting and having open pores capable of passing a solvent therethrough, placing the coated cores in a solvent for said soluble material for diffusing the solvent through the coating pores and for dissolving said cores.

2. A method as in claim 1 for the manufacture of hollow balls, and wherein said cores are spherical.

3. A method as in claim 2, and wherein said spherical cores have a diameter greater than 0.5 mm, and said porous coating has a thickness of at least 50 microns.

4. A method as in claim 1 and wherein said cores have a multitude of small cavities (26) opening into the outer surface thereof, and said coating is deposited on the surface outside the cavities so as to create a coating (30) having pores at the sites of said cavities.

5. A method as in claim 4 and wherein said cores comprise expanded plastic cores having cells opening into the outer surfaces thereof.

6. A method as in claim 5 and wherein said cores comprise expanded polystyrene cores, and said dissolution is carried out by immersion into a solvent selected from the group consisting of acetone, benzene, perchloroethylene, trichloroethylene and ether.

7. A method as in claim 6 wherein the deposition of the porous coating on the core comprises ($b_1$) roughing the cores so as to provide on their surface outside the cavities a roughness suitable for mechanical adhesion of said surface to metals, ($b_2$) immersing the cores into at least one chemical metallizing bath to electroplate at least one thin layer conducting coating (27, 28, 29) thereon, ($b_3$) immersing said cores into at least one electrolytic bath to electroplate at least one metal coating (30) on said thin conducting coating.

8. A method as in claim 6, including carrying out a chemical roughing by immersing and agitating the cores in bulk in a diluted solvent or diluted acid, and then rinsing after an immersion time corresponding to preselected surface action on the cores.

9. A method as in claim 8 and including carrying out a chemical roughing by immersion in acetone diluted in water by volume between 50 and 90% for a time between 600 and 5 seconds in inverse relationship to the concentration.

10. A method as in claim 7 and including sequentially immersing said cores in bulk into three chemical metallization baths, the first one comrpising a tin salt for depositing a thin tin sensitizing layer (27), the second one comprising a palladium or silver salt for depositing a thin palladium or silver catalytic layer (28), the third one comprising a nickel or copper salt for depositing a thin conducting nickel or copper coating (29).

11. A method as in claim 7 and wherein said electroplating comprises placing the cores in bulk in an open rotating barrel having cathodes (9) at its upper portion, immersing said barrel into a metal-salt based electrolytic bath containing anodes (8) dipping into said bath opposite the barrel, and applying a potential difference across the anodes and cathodes.

12. A method as in claim 11 and wherein said electrolytic bath comprises a nickel salt for achieving a crystallized layer of nickel or nickel alloy.

13. A method as in claim 11 and wherein said electrolytic bath comprises a nickel salt and a metalloid complex for achieving an amorphous nickel alloy coat.

14. A method as in claim 7 and including carrying out several electroplatings consecutively for producing a multi-layer coating.

15. A method as in claim 7 and including applying a chemical deposition of a metal layer by immersion of said bodies into a chemical metallizing bath for forming a new thin surface coat (31).

16. A method as in claim 1 and including producing at least one dense coat (33,34) on the porous coat by dipping, cathode sputtering, vacuum evaporation, vapor-phase chemical deposition or by molding.

17. A hollow body manufactured by carrying out the method of claim 1.

18. A hollow body as in claim 17 of spheroidal shape.

* * * * *